United States Patent [19]

Pufal

[11] Patent Number: 4,558,871

[45] Date of Patent: Dec. 17, 1985

[54] SEAL MEANS FOR COUPLINGS IN GAS CONDUITS

[75] Inventor: Rolf H. Pufal, Cologne, Fed. Rep. of Germany

[73] Assignee: Klöckner-Humboldt-Deutz AG, Fed. Rep. of Germany

[21] Appl. No.: 536,662

[22] Filed: Sep. 28, 1983

[30] Foreign Application Priority Data

Oct. 7, 1982 [DE] Fed. Rep. of Germany ..... 3237169
May 6, 1983 [DE] Fed. Rep. of Germany ..... 3316562

[51] Int. Cl.[4] ..... F16J 15/34
[52] U.S. Cl. ..... 277/84; 277/192
[58] Field of Search ..... 277/DIG. 1, 84, 192, 277/12, 73

[56] References Cited

U.S. PATENT DOCUMENTS 4,280,707 7/1981 Bliemeister ..... 277/84

FOREIGN PATENT DOCUMENTS 1181510 11/1964 Fed. Rep. of Germany ... 277/DIG. 1
1408802 12/1969 Fed. Rep. of Germany .
1433679 12/1969 Fed. Rep. of Germany .
2712899 10/1979 Fed. Rep. of Germany .

*Primary Examiner*—Robert I. Smith

[57] ABSTRACT

The invention relates to a seal means for couplings in gas conduits, particularly for the complete capture of hot exhaust gases which are conducted into a gas stack, for example the exhaust gases of coal gasification reactor. The invention provides a coupling which is gas-tight and pressure-proof, is employable in all attitudes, vertically, horizontally, obliquely, and which exhibits only slight overall height. The invention provides that the gas stack is closed relative to the reactor by means of a sealing element which is designed axially and/or radially movable, preferably as a telescope seal. The sealing element preferably includes compensator bellows for the absorption of the axially and radially effective forces.

9 Claims, 3 Drawing Figures

SEAL MEANS FOR COUPLINGS IN GAS CONDUITS

BACKGROUND OF THE INVENTION

1. Field of the Invention

The present invention relates to a seal means for couplings in gas conduits, particularly for the complete capture of hot exhaust gases which are conveyed into a gas stack, for example the exhaust gases of a coal gasification reactor.

2. Description of the Prior Art

A hood for capturing and forwarding the hot exhaust gases of steel mill converters is known from the German AS No. 1,433,679 but this hood is not sealed relative to the converter discharge. It is thereby disadvantageous that hot exhaust gas is mixed with secondary air, thus making this device unusable for employment as a hood of a coal gasification reactor.

Known from the German AS No. 2,712,899 is a device for regulating partial combustion of the reaction gases escaping from a steel converter, for compensating fluctuations in the gas development which briefly occur and for preventing pulsations building up on a gas collector, gas cooling and dedusting means, as well as a gas conduit system consisting of ventilator and pressure control means and having a liftable and lowerable retaining ring disposed between the crucible and the gas collecting component surrounded by a cooling ring. This device is likewise not entirely gas-tight and pressure-tight against internal excess pressure or underpressure.

The German AS No. 1,408,802 discloses a device for collecting converter exhaust gases which is equipped with an outlet sealable all around the converter discharge and having water-conducting wall parts for producing steam which serve the purpose of sealing the connection between the converter discharge and the outlet and for moistening the exhaust gases. In addition to other disadvantages, this seal means designed as a water lute is particularly not suitabale for closing the coupling location between converter and gas stack against internal excess pressure of the gas of, for example, 3 through 10 bar (approximately 3 through 10 atmospheres).

SUMMARY OF THE INVENTION

An object of the invention is to create a seal means for couplings in gas conduits which is gas-tight and pressure-proof, which is capable of employment in all attitudes, vertical, inclined, and horizontal, and which also exhibits a low overall height. This object is inventively resolved with a seal means wherein the gas stack is closed relative to the reactor by means of a sealing element which is designed axially and/or radially movable, preferably as a telescope seal. A gas-tight and pressure-proof seal for coal gasification reactors, for example, is advantageously presented for the first time. The reactor can thus be displaced relative to the gas stack or it is possible to turn both coupling elements relative to one another.

It is provided in a further development and embodiment of the invention that the sealing element exhibits bellow expansion joints for the absorption of the radially and axially effective forces. This measure creates a broad use spectrum for the seal means and results in cost-savings due to low fabrication outlay.

The sealing element of the present invention advantageously includes a gas interior which is equipped with a circulation gas connection. Penetration of dust and hot gases from the converter into the sealing element can thereby be prevented or, respectively, gas which has penetrated can be removed from the gas interior by means of producing an excess gas pressure.

It is provided in an advantageous development of the invention that the sealing element is equipped with a locking means designed as a quick-release closure, preferably an automatic bayonet catch. Disconnection of the reactor from the gas stack can thereby be undertaken quickly and in a simple manner during operation. Moreover, the automatic operating mode prevents persons from being injured due to emerging gases or possible detonations.

It is provided in an advantageous development of the invention that the gas stack wall comprises a water-cooled double shell. The sealing element can be protected against excessive temperature influence as a result of this expedient and simple measure. Simultaneously, the sensible heat of the exhaust gas can be exploited in this manner.

The gas stack wall can be advantageously designed as an evaporation cooler consisting of tubes proceeding parallel to the center axis of the stack. An evaporation cooler is particularly suited for cooling high temperature gases when the amounts of cooling water required are to be kept within limits.

It is further provided in an advantageous development of the invention that the reactor includes an outlet nozzle whose center line proceeds eccentrically relative to the center point of the reactor as an extension of the stack axis so that only slight axial play of the sealing element is necessary for locking the reactor to the stationary gas stack. The need for compensators and the apparatus devices connected therewith such as, for example, lift means, can be expediently reduced by so doing. Encrustations formed during operation at the coupling due to dust deposits are easily removed after conclusion of operations given single-sided tilting, i.e., disconnection of the reactor, since the encrustations are only stressed for tension. Insofar as the reactor were to be designed tiltable in both directions, that side of the reactor discharge respectively opposite the rotational direction would first be stressed for pression when tilting so that the encrustations would be highly solidified in a disadvantageous manner.

In a further advantageous development, the sealing element also includes an annular gap seal. Insofar as the reactor is rotationally designed at both sides for operational requirements a large annular gap derives between the reactor discharge and the gas stack. For this use, an additional annular gap seal expediently protects the sealing element in the area of the locking means against heat and the influence of dust.

In a further development of the invention, at least one inner and one outer bellow expansion joint are provided, these being disposed over a lifter means as well as guide rollers so as to be movable parallel to the gas stack. The overall height of the sealing element can advantageously be further reduced by so doing.

The locking means expediently exhibits an angular compensator, a water chamber with a contact face relative to the annular gap seal, as well as a guide strip. As a result of so doing the annular segments of the annular gap seal cannot shift given a pressure build-up but, rather, are held in position by the contact face of the water chamber. The angular compensator compensates for angular imprecisions at the sealing surface in a simple manner.

Further provided in an expedient development of the invention is that lifter means are uniformly distributed on the circumference of the gas stack shell and of the reactor shell at a spacing of approximately 75 cm, as are locking devices at a spacing of approximately 15 cm. It can thereby be achieved that the respective requisite power deriving from the pressure differential between the internal gas pressure and the exterior pressure as well as for the diameter of the gas stack as a further influencing variable can be exerted by means of commercially available fittings.

It is provided in a further development of the invention that the annular gap seal is formed of pre-shaped annular segments, preferably upon employment of lightweight refractory brick.

A thermal shield is provided for the seal means with great advantage, said shield protecting the sealing element against heat and dust given unlocking and separation of the gas stack from the reactor. The service life of the seal means is thereby extended and, thus, costs are saved in a simple manner. Such shields are thereby expediently pinned and stamped with fire-proof compounds. They can be moved into their intended positions either manually or automatically.

BRIEF DESCRIPTION OF THE DRAWINGS

The invention is explained in greater detail below with reference to a sample embodiment on the basis of the drawings. Shown are.

DESCRIPTION OF THE PREFERRED EMBODIMENTS

Figure 1:
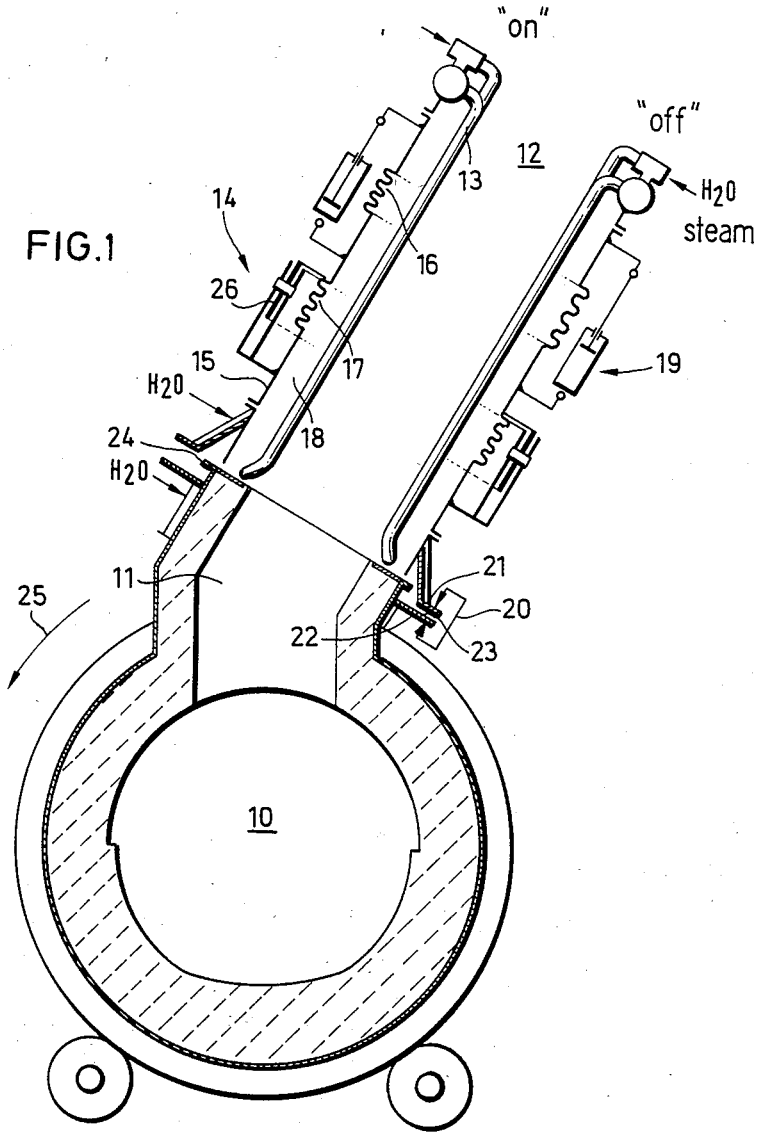
FIG. 1 is a schematic side sectional view of a seal means in an oblique position with a coal gasification reactor rotatable at one side.

FIG. 1 shows a coal gasification reactor 10 with an outlet nozzle 11 to which a gas stack 12 is connected. The wall of the gas stack 12 is designed as an evaporation cooler 13 consisting of tubes proceeding parallel to the center axis of the stack which, viewed in lateral cross-section, can form an annulus but which can also form other stack cross-sections. The sealing element 14 consists of a sealing shell 15 which also includes compensator bellows 16, 17. An inside gas space 18 is formed between the gas stack wall 13 formed by the tubes and the sealing shell 15. The axial compensator 16 enables the lifting motion of the sealing shell 15 parallel to the axis of the gas stack and is synchronously moved over hydraulic cylinders 19 or over spindle lifter elements as well.

Mulitdirectionally movable angular compensators 17 serve for the absorption of radially effective forces. A known, cardanic suspension guarantees the multidirectional mobility of the angular compensator 17. Given an oblique attitude of the gas stack 12 and of the sealing shell 15, a counter-weight conducted over a roller can serve for the compensation of the dead weight. Other measures at the command of one skilled in the art such as, for example, support by means of laminated springs or a pneumatic buffering, however, are also conceivable.

At the side of the sealing element 14 lying adjacent the reactor outlet nozzle 11, the sealing element 14 includes a locking means 20 (shown in the right half of the figure) which secures the frame 21 (water-cooled under given conditions) to the flange 22. The sealing surface 23 situated between the support frame 21 and flange 22 can include further sealing elements, for example, annular gas seals or seals consisting of soft materials. The reactor outlet nozzle 11 has a drip edge 24 at its discharge face which protects the sealing surface 23 on the flange 22 from damage when emptying the reactor 10 due to emerging metal or slag. An emptying of the reactor 10 ensues after unlocking the closure 20 and rotation in the direction of arrow 25.

It can be seen in FIG. 1 that the outlet nozzle 11 has a center line proceeding eccentrically relative to the center point of the reactor 10 as an extension of the stack axis so that only slight axial play of the sealing element 14 is necessary for locking the reactor to the stationary gas stack 12.

Figure 2:
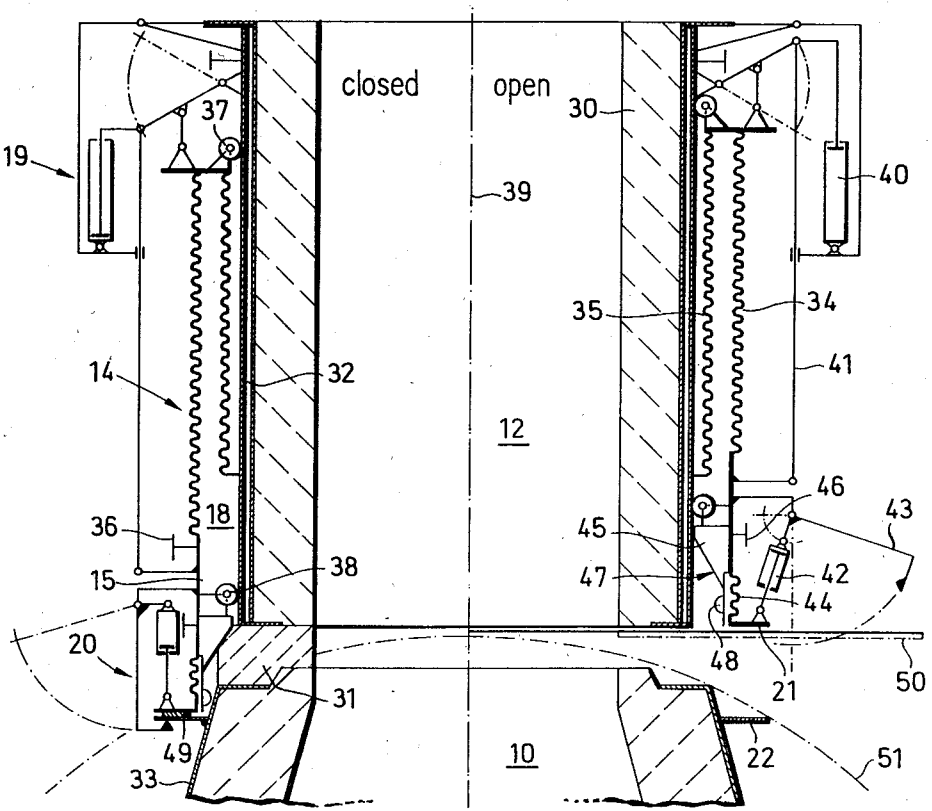
FIG. 2 is a schematic side sectional view of a seal means in a vertical position with a coal gasification reactor rotatable at both sides.

FIG. 2 shows the reactor mouth of a coal gasification reactor 10 as well as a gas stack 12 disposed thereabove, the gas stack wall 30 being lined. An annular gap seal 31 (shown in the left half of the figure) is provided between the mouth of the reactor 10 and the gas stack wall 30. The gas stack shell is designed as a water-cooled double shell 32, whereas the reactor shell 33 is uncooled in this instance. It may be desireable to also cool parts of the reactor shell 33. The sealing element 14 exhibits an inside gas space 18 which is essentially limited by the sealing shell 15, an outer compensator bellows 34, an inner compensator bellows 35 and the double shell 32. The inside gas space 18 has a circulation gas connection 36. The compensator bellows 34, 35 are conducted over the lifter means 19 by means of the guide rollers 37, 38 so as to be movable parallel to the center axis 39 of the stack. The lifter means 19 thereby includes lift and pressure relief cylinders 40 as well as a suitable lifter rodding 41. The sealing element 14 also includes a locking means 20 with an unlocking and locking cylinder 42, an unlocking and locking clamp 43, an angular compensator 44, and water chamber 45 having a cooling water connection 46, whereby the contact face 47 of the water chamber is angularly designed. Additionally, the locking means 20 also includes a guide strip 48 as a contact ring to the reactor shell 33. The locking means 20 locks the support frame 21 to the flange 22 which is welded to the reactor shell 33 and on which a seal 49 of soft material is situtated. A shield 50 protects the sealing element 14 against heat and dust in the open condition. The reactor 10 is disposed relative to the gas stack 12 so as to be rotatable at both sides on the described circle 51.

Figure 3:
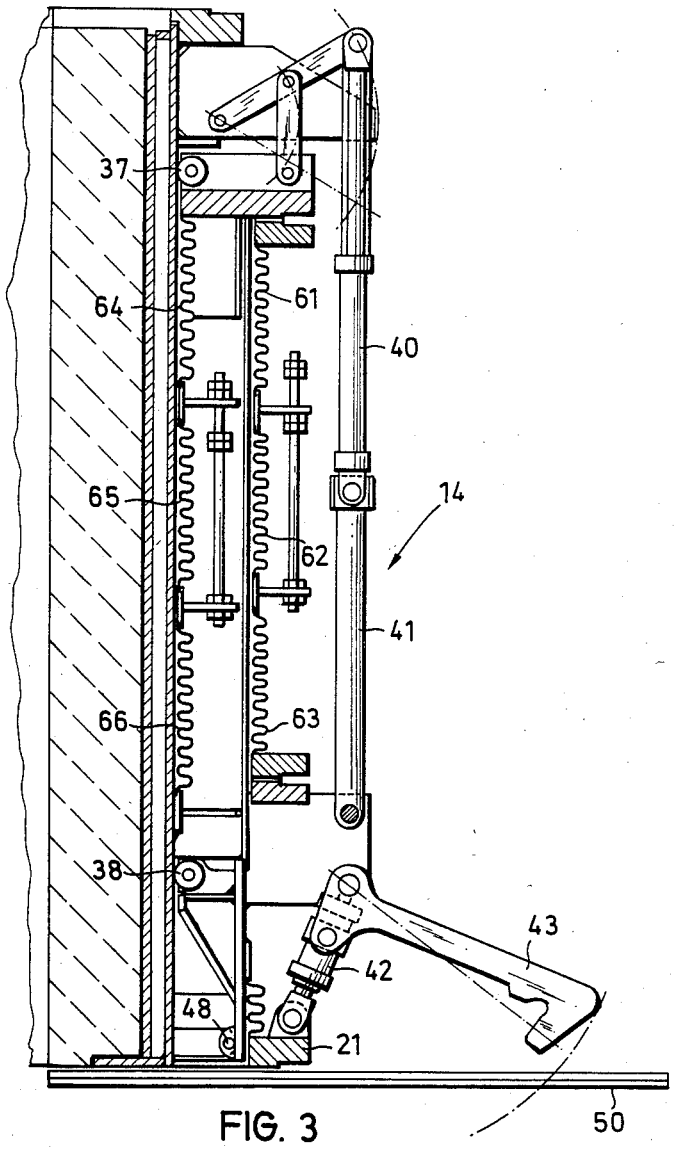
FIG. 3 is a partial side sectional view of the seal means in its opened condition.

FIG. 3 shows a structural execution of the sealing element 14 in the open condition, whereby a plurality of outer compensatores 61, 62 and 73 as well as inner compensators 64, 65, 66 have been employed to provide the desired telescopic action.

Upon operation of the seal means, the reactor 10 filled with molten iron is operationally ready in a tilted position. Before rotation of the reactor 10 on the described circle 51 according to FIG. 2, the insufflation nozzles of the iron bath reactor 10 are charged with a specific amount of gas so that the nozzles do not run shut when they dip into the iron bath. Hot, dust-charged exhaust gases are thereby necessarily generated. The reactor mouth is then pivoted into the position directly below the gas stack 12. The ejected gas stream first proceeds into the open surroundings through the annular gap 31 which is not yet closed. The shield 50 protects the sealing element 14 against dust and heat. A certain underpressure or partial vacuum is required in the gas stack 12 during pivot of the reactor 10 so that the hot exhaust gases enter into the gas stack 12. The thermal shield 50 can then be automatically removed with the assistance of a simple, mechanical device. At the same time, the pre-shaped annular segments are placed into the annular gap 31. These may, for example, consist of light refractory brick or fibrous material. The annular gap seal 31 is suitable for protecting the sealing element 14 against excessive heat load and dust influence. Over the lifting rodding 41, the hydraulic jacks 40 then uniformly lower the sealing element 14 onto the flange 22 at the reactor mouth. The inner compensator bellows 35 or, respectively, 64, 65, 66 are thereby compressed and the outer compensator bellows 34 or, respectively, 61, 62, 63 are extended. The locking cylinder 42 lowers the locking clamp 43 down to the flange 22 and subsequently presses the support frame 21 of the angular compensator 44 against the seal 49. The sealing element 14 is thereby guided over guide rollers 37, 38 at the water-cooled double shell 32 and by means of the guide strip 48 which determines the precise position of the sealing element 14 relative to the reactor mouth. The reactor 10 can now be run up to production and overpressure.

In order to counteract against the reaction forces resulting from the pressure built-up in the sealing element 14, the cylinder 40 is oppositely actuated, i.e., the lifter/tension rodding 41 is stressed for tension. The annular segments 31 are held in this position by means of the contact face 47 of the water chamber 45 so that they cannot shift or be displaced during the pressure built-up. Reactor 10 and gas conduit 12 are thereby connected to one another gas-tight and pressure-proof. Reaction forces due to pressure and longitudinal expansions of the gas stack 12 are constantly compensated by the lift and pressure relief cylinder 40. The angular compensator 44 compensates angular imprecisions at the sealing surface.

When the reactor 10 is to be setback, these steps sequence in the reverse order. During setback, the overpressure is dissipated, and the system is switched to underpressure. In addition, a circulation gas, for example N or some other inert gas is pumped over the circulation gas connection 36 into the sealing element 14 in order to displace combustible and explosive gases. As a result of actuating the cylinder 42, the seal 49 is relieved, the clamp 43 is unlocked and pivoted away (as shown in the right half of FIG. 2). The cylinder 40 which was again previously switched, can again lift the telescope closure 14. The annular segments 31 are removed and the thermal shield 50 is inserted. The reactor 10 can then be tilted into its idle position along the described circle 51.

The cylinders 40 and 42 can be designed either hydraulically or pneumatically. Other lifter elements are also conceivable, for example spindle lift elements or other technical equivalents. The heat emanating from the gas stack 12 toward the outside is removed by means of the cooling jacket 3 and the annular water chamber 45 and the closure parts of the sealing element 14 which lie at the outside are thus protected against excessive influence of heat. The annular segments 31 as well as the seal 49 of soft material are to be viewed as wearing parts and should be replaced before each actuation of the closure. The upper part of the lifter and tension rodding 41 is disposed such that the inside and outside compensators 34, 35 experience identical changes in length independently of the respective pressure conditions. A plurality of lifter and locking devices 19, 20 are distributed over the circumference of the gas stack shell or, respectively, of the reactor jacket corresponding to the respective requisite force.

The seal device according to the invention is also employable in all similar cases; in particular, it is within the discretion of one skilled in the art to determine the combination or, respectively, employment of axial compensators and/or angular compensators in accord with the respective demands.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

I claim as my invention:

1. A gas stack sealing arrangement for a coal gassification iron bath reactor comprising:

a rotatable vessel with a gas exhaust conduit having a first end extending perpendicular to an axis of rotation thereof and having an open second end extending at an oblique angle from said first end;

a gas stack with an open bottom end aligned with said open second end of said gas exhaust conduit in one rotational orientation said vessel and spaced from said gas exhaust conduit to permit rotation of said vessel;

a seal means comprising a flexible bellows attached at a first end to said gas stack and having an open second end axially movable to engage with said gas exhaust conduit when said vessel is in said one rotational orientation;

said gas exhaust conduit having a circumferential flange adjacent to an open end of said conduit;

said seal means having a support frame circumferentially surrounding said open second end of said seal means;

a locking means secured at one end to said support frame and lockingly engagable with said exhaust conduit flange to lock said exhaust conduit and said gas stack together at said support frame and said flange;

said seal means further comprising lifting means to move said open second end axially to permit rotational clearance for said vessel.

2. A sealing arrangement according to claim 1 including a soft seal member provided between said gas exhaust conduit flange and said seal means support frame.

3. A sealing arrangement according to claim 1 wherein said rotatable vessel includes a circumferential drip flange at said open second end of said gas exhaust conduit to protect a sealing surface on said circumferential flange when emptying said vessel in a rotated position.

4. A sealing arrangement according claim 1 wherein said first end of said flexible bellows is attached to the exterior of said gas stack at a position axially spaced from said open bottom end of said gas stack to form an annular space between said bellows and said gas stack.

5. A gas stack sealing arrangement for a coal gassification iron bath reactor comprising:

a rotatable vessel with a gas exhaust conduit having a first end extending perpendicular to an axis of rotation thereof and having an open second end forming a mouth extending at an oblique angle from said first end;

a gas stack with an open bottom end aligned with said open second end of said gas exhaust conduit in one rotational orientation of said vessel and spaced from said gas exhaust conduit to permit rotation of said vessel;

said gas stack being lined with refractory material and having a double exterior wall for receiving a cooling liquid;

a seal comprising a flexible bellows attached at a first end to said gas stack at a point spaced above said open bottom end to form a space between said bellows and said gas stack and having an open second end axially movable to engage with said gas exhaust conduit when said vessel is in said one rotational orientation;

said gas exhaust conduit having a circumferential flange adjacent to an open end of said conduit;

said seal means having a support frame circumferentially surrounding said open second end of said seal means;

an annular seal member made of refractory material insertable between said vessel mouth and said gas stack open bottom to reduce the amount of exhaust gas directed against said seal means;

a shield member selectively insertable below said open second end of said seal means and said gas stack open bottom end to protect said seal means against dust and heat when said means is in a lifted position;

a locking means secured at one end to said support frame and lockingly engagable with said exhaust conduit flange to lock said exhaust conduit and said gas stack together at said support frame and said flange;

said seal means further comprising lifting means to move said open second end axially to permit rotational clearance for said vessel.

6. A sealing arrangement according to claim 5 wherein said bellows comprises an inner bellows and an outer bellows with a space therebetween, the inner bellows attached at one end to said gas stack and at a second end to a first end of said outer bellows, said outer bellows having a second end axially movable relative to said gas stack open end.

7. A sealing arrangement according to claim 6 wherein said second end of said inner bellows and said first end of said outer bellows are carried on said gas stack over guide rollers which engage said outer wall of said gas stack.

8. A sealing arrangement according to claim 5 wherein said support frame is attached to said seal means via an angular compensator.

9. A sealing arrangement according to claim 5 including a gas circulation connection which communicates with the space between said bellows and said gas stack such that an inert gas can be pumped into said space to displace combustible and explosive gases.

* * * * *